US006253418B1

(12) United States Patent
Schmidhauser et al.

(10) Patent No.: US 6,253,418 B1
(45) Date of Patent: Jul. 3, 2001

(54) RUNNING MECHANISM ASSEMBLY FOR A SLIDING DOOR

(75) Inventors: Heinz Schmidhauser, Zihlschlacht; Heinz Zingg, Niederuzwil, both of (CH)

(73) Assignee: EKU AG, Sirnach (CH)

( * ) Notice: Subject to any disclaimer, the term of this patent is extended or adjusted under 35 U.S.C. 154(b) by 0 days.

(21) Appl. No.: 09/377,126

(22) Filed: Aug. 19, 1999

(30) Foreign Application Priority Data

Aug. 21, 1998 (CH) ..... 1720/98

(51) Int. Cl.[7] ..... E05D 13/00

(52) U.S. Cl. ..... 16/91; 16/97; 16/102; 49/409; 49/425

(58) Field of Search ..... 16/99, 105, 91, 16/97, 102, 103, 104, 87.6 R, 87.8, 96 R; 49/420, 409, 425, 212

(56) References Cited

U.S. PATENT DOCUMENTS

| | | | | |
|---|---|---|---|---|
| 3,142,859 | * | 8/1964 | Suska | 49/409 |
| 3,526,995 | * | 9/1970 | Saunders | 16/99 |
| 3,731,431 | * | 5/1973 | Banner | 49/420 |
| 3,808,633 | * | 5/1974 | Lauterbach | 49/409 |
| 4,006,513 | * | 2/1977 | Offterdinger | 16/99 |
| 5,404,675 | * | 4/1995 | Schmidhauser | 49/409 |

* cited by examiner

*Primary Examiner*—Chuck Y. Mah
*Assistant Examiner*—Enoch E Peavey
(74) *Attorney, Agent, or Firm*—Akin, Gump, Strauss, Hauer & Feld, L.L.P.

(57) ABSTRACT

A running mechanism assembly includes a profile element (5) whose hollow space (10) with the guide groove (9) is laid bare by a recess (15), which makes possible the perpendicular insertion of the running mechanism (19). The running mechanism (19) is locked within the guide grove (9) by displacement within the latter.

9 Claims, 1 Drawing Sheet

RUNNING MECHANISM ASSEMBLY FOR A SLIDING DOOR

BACKGROUND OF THE INVENTION

The invention relates to a running mechanism assembly for a sliding door, including a profile element with a hollow space on the upper edge of the sliding door and an upwardly opening guide groove for accommodating a running mechanism, which is constructed and adapted for engaging in a guide rail lying above it on a cabinet or on a ceiling and for guiding the sliding door suspended on running rollers.

The running mechanisms which carry a sliding door and are guided in a rail arranged above the sliding door are usually screwed firmly on the upper edge of the sliding door and, in case the latter is closed off above with a profile, the running mechanism is inserted into the profile at the end and then held fast by a locking device. With sliding doors which are surrounded by an enclosing frame, the running mechanism cannot, for aesthetic reasons, be screwed on above or be inserted through an opening laterally penetrating the frame in the profile closing off the upper edge.

SUMMARY OF THE INVENTION

An object of the present invention is to create a running mechanism assembly in which insertion of the running carriage is possible without a lateral end penetration of the frame profile surrounding the sliding door.

This objective is accomplished by a running mechanism assembly wherein a recess is provided in the profile element so as to partially expose the guide groove and the hollow space, which recess allows the insertion and fastening of the running mechanism horizontally from behind or from above into the guide groove.

Owing to the recess exposing the guide groove on the back side of the sliding door or on its upper edge, the running mechanism can be introduced, without the use of tools, perpendicular to the longitudinal extension of the guide groove into the latter and locked therein by longitudinal displacement. No further parts are necessary for locking the running mechanism. The recess is not visible from the outside of the cabinet, and therefore requires no subsequent covering. The running mechanism can be removed from the profile frame of the sliding door at any time for working on the sliding door or when changing it. The running mechanism as well as the recess in the profile element on the sliding door can be economically manufactured.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise assemblys and instrumentalities shown. In the drawings.

DETAILED DESCRIPTION OF THE INVENTION

Figure 1:
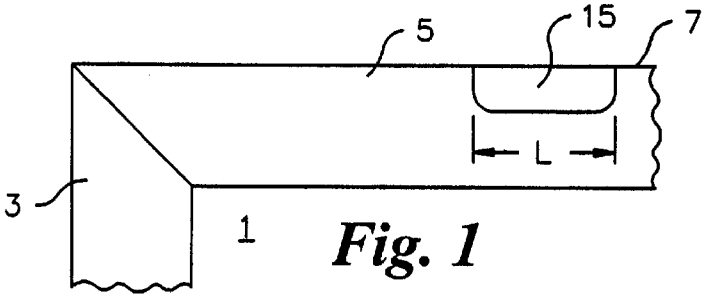
FIG. 1 depicts a cutaway side view of the upper edge and a side edge of a sliding door.
Figure 4:
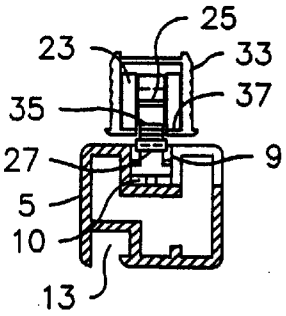
FIG. 4 is a cross section along line IV—IV in FIG. 3.

In FIG. 1 the left upper comer of a sliding door 1 is visible in cutaway. The edges of the sliding door 1 are enclosed by vertically and horizontally running profile elements 3, 5 and joined with the latter. Drawn hollow aluminum profiles or plastic profiles can be used as profile elements 3, 5. The cross-section of the profile is preferably rectangular, and a box-shaped guide groove 9 is embedded in its upper edge 7, which is closed off above by two guide projections bounding the guide groove 9 laterally. A further groove 13 (FIG. 4) is formed on the lower edge of the profile element 5, into which the upper edge of the sliding door 1 is insertable and lockable.

Figure 3:
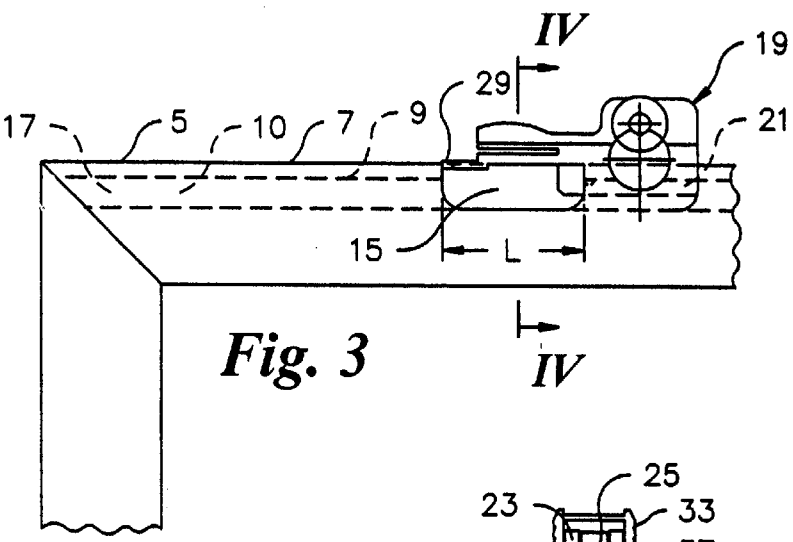
FIG. 3 is a cutaway side view as in FIG. 1 with inserted running mechanism.
Figure 2:
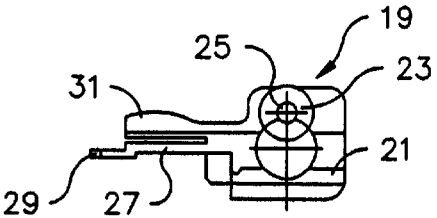
FIG. 2 is a side view of a running mechanism.
Figure 6:
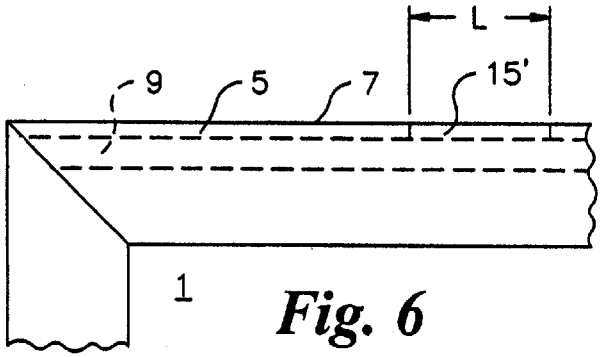
FIG. 6 is a cutaway side view of the upper edge and a side edge of a sliding door.

In the first embodiment in accordance with FIGS. 1, 2 and 3, a recess 15, laterally opening the groove 9 or the hollow space formed by groove 9, is installed in the horizontally lying profile element 5. The recess 15 extends down to the bottom of the groove and has a length L which corresponds to the length of the guide element 21 of a running running mechanism 19, or is slightly larger. The recess 15 consequently lays bare the guide groove 9 and the hollow space 10 in profile 5 from the side and permits lateral insertion of the running mechanism 19 into the guide groove 9 perpendicular to the longitudinal extension of the latter. The running mechanism 19 includes, in addition to guide element 21, a pair of rollers 23 which is carried by an axle 25, and a locking element 27 which extends at right angles to the axle 25. The locking element 27 or its end 29 lies higher than the guide element 21 and is constructed tongue-like. Above the locking part 27, a stopper element 31 can additionally be constructed for braking and holding the sliding door 1 firmly in the end position .

The rollers 23 are guided in a guide rail 33 (FIG. 4), which is embedded in the ceiling of a cabinet or the ceiling of a room (not shown). The guide rail 33 includes a hollow profile with a groove 35 laying bare the hollow space below. At the sides of the groove 35 guide tracks 37 are provided, on which the rollers 23 can roll.

The running mechanism 19 can be made of plastic or metal. During the manufacture of a cabinet, it is introduced at the end into the guide rail 33 and is held in the guide rail 33 during transport. For connecting the sliding door 1 with the running mechanism 19 (usually there are two of them per door plate), the sliding door 1 is introduced to the cabinet from the front and pushed under the running mechanism 19. This is possible since the guide elements 21 of the running mechanism 19 can be inserted through the recesses 15 into the profile elements 5 on the sliding door 1. After inserting the running mechanism 19 or its guide element 21 into the profile elements 5, the running mechanisms 19 are pushed in the displacement direction of the sliding door so far to right, until the locking elements 27 or the ends 29 of the locking elements (which after insertion are at first suspended to the side of the recess 15 on the profile element 5) lock into the recess 15 (compare FIG. 3). The running mechanism 19 is now connected firmly with the sliding door 1 in all directions.

If a sliding door 1 must subsequently be removed from the cabinet, the ends 29 of the locking device 27 must be lifted with a screw driver, which is introduced into the recess 15, so that the running mechanism 19 is displaceable in the longitudinal direction of the door, in the present case to the left, and is thereby removable from the sliding door 1 through the recess 15 perpendicular to the sliding direction.

Figure 5:
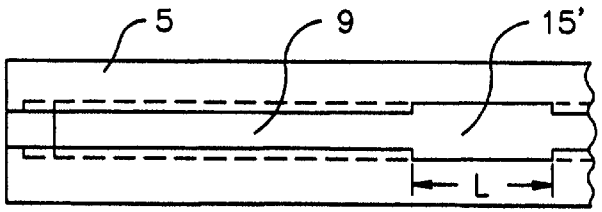
FIG. 5 is a top view of a sliding door with a recess in the profile element.

The second embodiment of the invention in accordance with FIG. 5 differs from the first one in that the recess 15' does not lay bare the groove 9 from the side, but rather from above. The recess 15' is thus rectangular and permits inserting the sliding door 1 from below into the running mechanism 19, and afterward displacing the running mechanism 19 laterally, as described in the first embodiment, until locking of the locking element 27 takes place within the recess 15'.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. A combination profile element (5) and running mechanism assembly for a sliding door (1), said combination comprising:

a profile element (5) for being fastened on an upper edge (7) of the sliding door (1), the profile element (5) including a hollow space (10) centrally located in the profile element (5) and an upwardly opening guide groove (9) positioned above the hollow space (10);

a running mechanism (19), having running rollers (25), for being positioned within a guide rail (33) located proximate the profile element (5) for guiding the sliding door (1), the profile element (5) having one of a first recess (15) cut into a lateral edge of the profile element (5) permitting horizontal insertion of the running mechanism (19) into the first recess (15) and a second recess (15') cut into an upper edge (7) of the profile element (5) permitting vertical insertion of the running mechanism (19) into the second recess (15'), the first and second recesses (15, 15') partially exposing the guide groove (9) and the hollow space (10) permitting fastening and locking of the running mechanism (19) to the profile element (5).

2. The combination according to claim 1, wherein the first recess (15), exposes the guide groove (9) and the hollow space (10) and a bottom plane (17) of the hollow space (10).

3. The combination according to claim 1, wherein the second recess (15') exposes the guide groove (9) and the hollow space (10).

4. The combination according to claim 1, wherein the first recess (15) and the second recess (15') have a length (L) which permits a perpendicular introduction of the running mechanism (19) into one of the first recess (15) and the second recess (15').

5. The combination according to claim 1, wherein the running mechanism (19) has a guiding element (21) which fastens the running mechanism (19) to the profile element (5) by inserting the guiding element (21) into the guide groove (9) and the hollow space (10).

6. The combination according to claim 5, wherein the running mechanism (19) has a locking element (27) with a formed end (29), which further holds the guiding element (21) in the guide groove (9) and the hollow space (10), thereby holding the running mechanism (19) in the profile element (5).

7. The combination according to claim 6, wherein the locking of the running mechanism (19) by the locking element (21) is accomplished by sliding the running mechanism (19) perpendicular to the direction of its introduction into one of the first recess (15) and the second recess (15').

8. The combination according to claim 6, wherein the locking element (27) pivots elastically relative to the guide element (21).

9. The combination according to claim 1, wherein the fastening and locking of the running mechanism (19) to the profile element (5) is accomplished solely by interlocking the running mechanism (19) to the profile element (5).

* * * * *